US006603952B2

(12) United States Patent
Hoene et al.

(10) Patent No.: US 6,603,952 B2
(45) Date of Patent: Aug. 5, 2003

(54) PRINT MEDIA INPUT DEVICE

(75) Inventors: Keith Hoene, Boise, ID (US); Robert Sesek, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/022,766

(22) Filed: Dec. 13, 2001

(65) Prior Publication Data

US 2003/0113148 A1 Jun. 19, 2003

(51) Int. Cl.[7] ..... G03G 15/00; B65H 1/26

(52) U.S. Cl. ..... 399/393; 271/157; 399/23; 399/391

(58) Field of Search ..... 399/381, 388, 399/391, 393, 23; 271/145, 157, 158; D18/44, 49

(56) References Cited

U.S. PATENT DOCUMENTS 5,085,421 A * 2/1992 Sellers ..... 271/157 X
5,102,112 A * 4/1992 Takahashi ..... 271/157 X
5,150,893 A * 9/1992 Uno et al. ..... 271/157
5,157,448 A * 10/1992 Lang ..... 399/23
5,347,350 A * 9/1994 Nakahata et al. ..... 399/23
5,359,402 A * 10/1994 Nakahata et al. ..... 399/391

* cited by examiner

*Primary Examiner*—Sandra Brase

(57) ABSTRACT

The present disclosure relates to a print media input device. In one embodiment, the input device comprises a housing that defines an interior compartment that includes a storage compartment in which print media can be stored, and at least one lifting tray that is adapted to support print media that are to be fed to another device. In another embodiment, the input device comprises a housing that defines an interior space, a first lifting tray adapted to store print media, and a second lifting tray adapted to feed print media to another device, wherein the first and second lifting trays can be vertically displaced both independently and in unison.

18 Claims, 4 Drawing Sheets

PRINT MEDIA INPUT DEVICE

FIELD OF THE INVENTION

The present disclosure relates to a print media input device. More particularly, the disclosure relates to a high capacity input device that provides print media storage.

BACKGROUND OF THE INVENTION

High capacity input (HCI) devices are often used with printing devices (e.g., printers, photocopiers, etc.) to supply print media (e.g., paper) to the printing devices. By way of example, these HCI devices can store as many as 2000 sheets or more of paper. Normally, the print media are stacked on a lifting tray that displaces vertically as media are removed from the stack by a media feeding mechanism.

HCI devices typically can be configured to house various sizes of print media. For instance, several HCI devices are configured for use with letter-sized media (8.5 in.×11 in.), legal-sized media (8.5 in.×14 in.), 11 in.×17 in. media, A4 media (8.27 in.×11.69 in.), A3 media (11.69 in.×16.53 in.), etc. Although providing for increased printing options, such flexibility normally translates into inefficient space utilization. Specifically, when relatively narrow media are used in the HCI device (e.g., letter, A4), the majority of the HCI device compartment is unused. This is, of course, an undesirable result where "high capacity" storage/supply is desired.

In addition to wasting space, underutilization of the HCI device compartment also creates potentially hazardous situations. In particular, where one side of the compartment is filled to capacity with print media and the other is empty, the weight of the HCI device, and therefore the printing device, is not balanced. Therefore, when the printing device is to be moved, tipping can occur, e.g., when the printing device is wheeled over a bump.

From the foregoing, it can be appreciated that it would be desirable to have an HCI device that avoids one or more of the disadvantages noted above.

SUMMARY OF THE INVENTION

The present disclosure relates to a print media input device. In one embodiment, the input device comprises a housing that defines an interior compartment that includes a storage compartment in which print media can be stored, and at least one lifting tray that is adapted to support print media that are to be fed to another device.

In another embodiment, the input device comprises a housing that defines an interior space, a first lifting tray adapted to store print media, and a second lifting tray adapted to feed print media to another device, wherein the first and second lifting trays can be vertically displaced both independently and in unison.

In yet a further embodiment, the input device comprises an outer housing that defines an interior space, and a pull-out drawer that is slidable in and out of the interior space, the drawer supporting first and second lifting trays, the first lifting tray being adapted to store print media and the second lifting tray being adapted to feed print media to another device.

The present disclosure further relates to a method for operating an input device. In one embodiment, the method comprises the steps of supporting print media with at least one of two lifting trays contained within the input device, placing a media guide of the input device adjacent the print media, and controlling displacement of the two lifting trays depending upon the position of the media guide, wherein only one lifting tray is displaced when the media guide is in a first position and both lifting trays are displaced in unison when the media guide is in a second position.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Disclosed is a print media input device that provides for print media storage. To facilitate description of the inventive device, an example input device is discussed with reference to the figures. Although this device is described in detail, it will be appreciated that it has been described for purposes of illustration only and that many modifications are feasible without departing from the inventive concept. After the description of the example device, operation of the device is described to explain the manner in which the device can be used.

Figure 1:
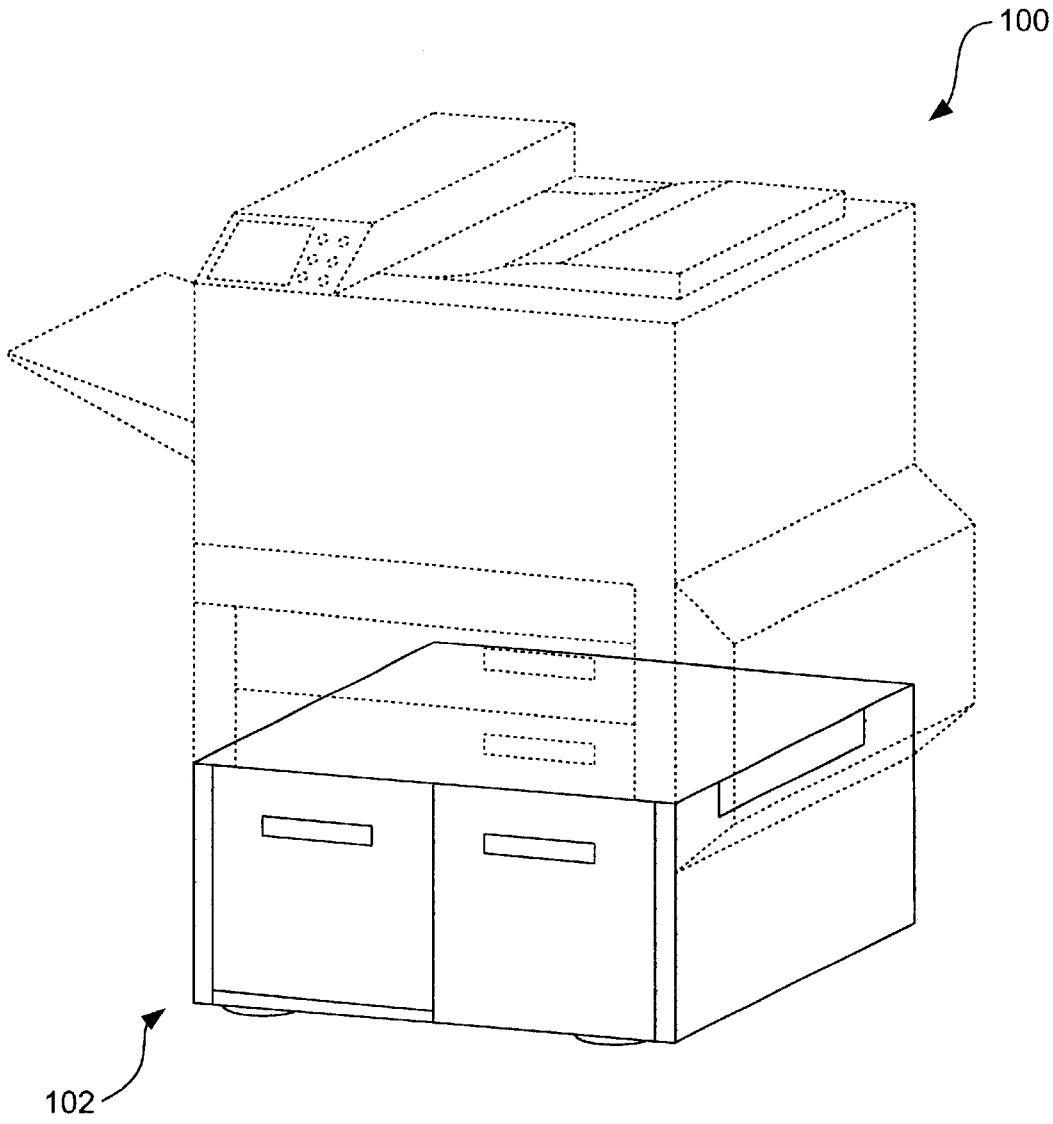
FIG. 1 is a schematic perspective view of a printing device used with a high capacity input device.

Referring now to the drawings, in which like numerals indicate corresponding parts throughout the several views, FIG. 1 illustrates a printing device 100 (shown in phantom lines) used with a high capacity input (HCI) device 102. As indicated in FIG. 1, the printing device 100 can comprise a printer. Although a printer has been identified and shown, it is to be understood that the printing device 100 can comprise any device that is capable of generating hard copy documents including, for example, a photocopier, multifunction peripheral (MFP), facsimile machine, etc. As is further indicated in FIG. 1, the printing device 100 can be mounted atop the HCI device 102 such that the printing device and HCI device form an integrated unit.

Figure 2:
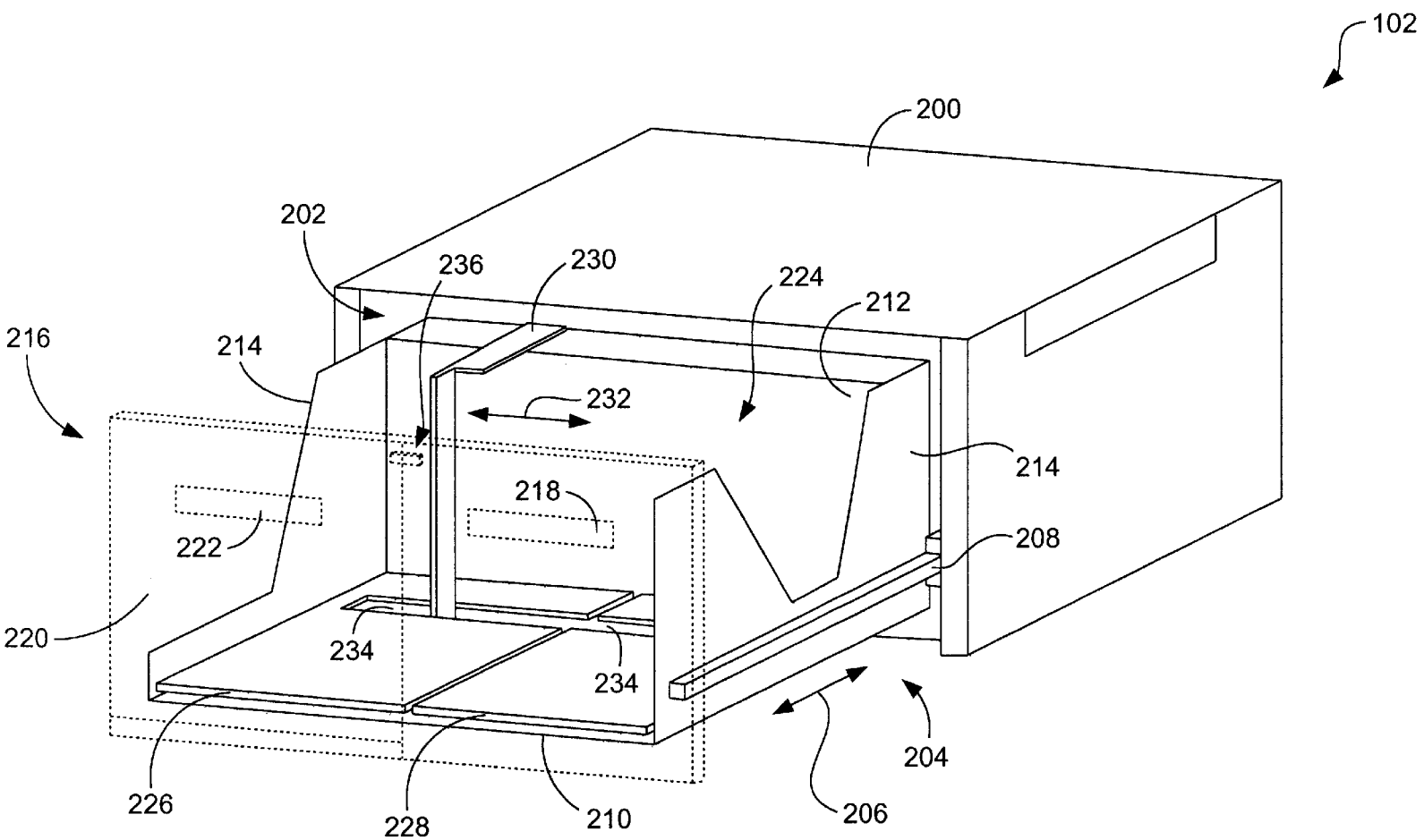
FIG. 2 is a schematic perspective view of the high capacity input device shown in FIG. 1.

The HCI device 102 is illustrated in greater detail in FIG. 2. As indicated in this figure, the HCI device 102 comprises an outer housing 200 that defines an interior space 202. Housed within the interior space 202 is a print media pull-out drawer 204 that, as indicated by arrow 206, is capable of sliding in and out of the interior space along rails 208 (only one visible in FIG. 2). The print media drawer 204 is adapted to physically support print media within the HCI device 102 during use and generally comprises a base 210, a rear wall 212, and opposed lateral walls 214. Opposite the rear wall 212 is a front panel 216 (shown in phantom lines). As is discussed in more detail below, the front panel 216 comprises a drawer handle 218, a storage compartment door 220, and a storage compartment door handle 222.

Together, the base 210, rear wall 212, lateral walls 214, and the front panel 216 generally define an interior compartment 224 in which the print media can be housed (i.e., in the drawer 204). As identified in FIG. 2, the interior compartment 224 contains first and second lifting trays 226 and 228 and at least one media guide 230. Where the HCI device 102 is viewed from the perspective of FIG. 2 (i.e., from its front), the trays 226 and 228 can be designated left and right lifting trays, respectively. As will be discussed below, these trays 226 and 228 are capable of lifting independently as well as in unison. The media guide 230 is used to align the print media within the interior compartment 224 as well as identify the size of the media to the HCI device 102 and, potentially, to the printing device 100. As indicated by arrow 232, the media guide 230 can be moved laterally side-to-side (right to left and vice versa) by the user to accommodate the width of the print media that has been placed in the compartment 224. To facilitate lateral displacement of the media guide 230 as well as vertical displacement of the lifting trays 226 and 228, the lifting trays can comprise media guide slots 234. Although shown as continuous slots 234, multiple separate slots (i.e., openings) could be used instead (e.g., positioned at common media widths), if desired.

In addition to the above-noted components, the HCI device 102 can include a lock mechanism 236 that can be used to lock the storage compartment door 220 against opening. As is described below, this lock mechanism 236, where provided, is typically engaged when the HCI device 102 is used to supply relatively wide print media to the printing device 100.

Although several different components have been identified in relation to FIG. 2, it is to be understood that several other features may be present in the device 102 which have been omitted from the figure for purposes of clarity. For example, not depicted in FIG. 2 is a second media guide. As is known in the art, a second media guide that is adjustable in the front-to-back direction, i.e., which can be displaced in a direction orthogonal to the axis of displacement of the media guide 230, can be provided. In addition, a lifting mechanism for lifting one or both of the lifting trays 226 and 228 has not been identified. Such lifting mechanisms are, however, known in the art. Additionally, a print media feed mechanism (e.g., pick rollers, etc.) has not been depicted but may be incorporated into the HCI device 102 as a means to feed print media to the printing device 100.

Figure 3:
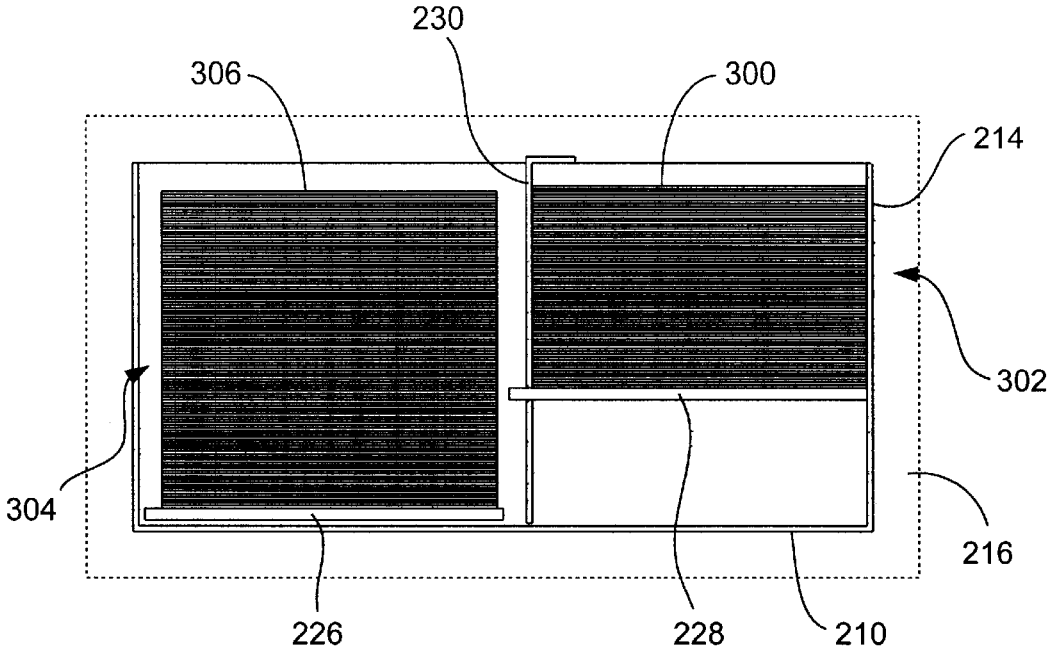
FIG. 3 is a schematic front view of the high capacity input device shown in FIG. 2 as used to provide separate storage and feeding of relatively narrow print media.
Figure 4:
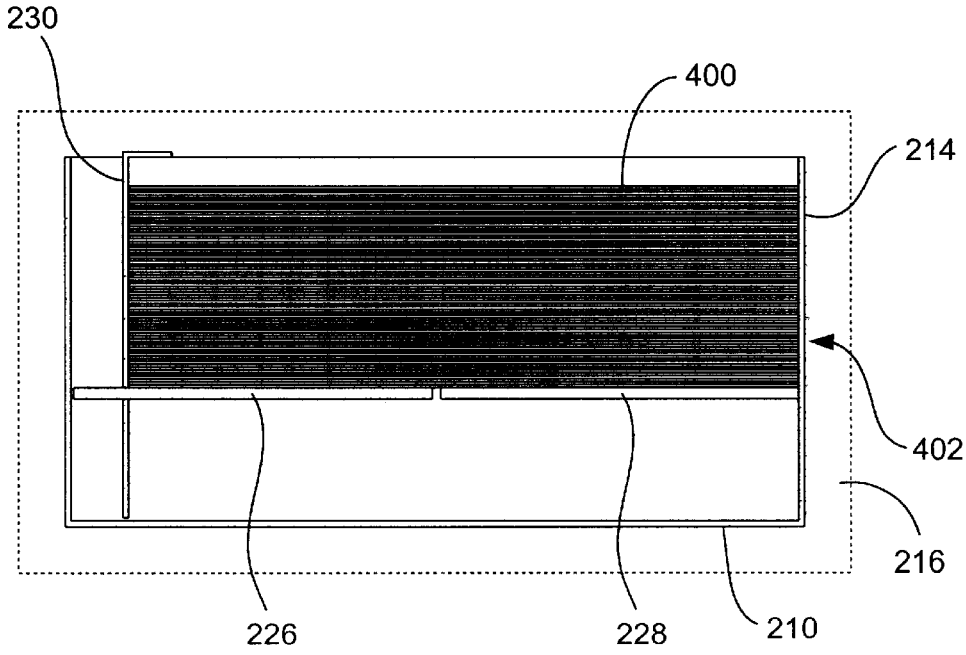
FIG. 4 is a schematic front view of the high capacity input device shown in FIG. 2 as used to provide feeding of relatively wide print media.

In use, the HCI device 102 can be used to simultaneously and separately store and feed relatively narrow print media as well as feed relatively wide print media. Examples of these modes of operation are illustrated in FIGS. 3 and 4, respectively. Beginning with FIG. 3, illustrated is the feeding of print media (e.g., sheets of paper) 300 from a right-side stack 302 of print media. As indicated in FIG. 3, the right-side stack 302 is supported by the second lifting tray 228, which is shown in a vertically displaced orientation. In this mode of operation, only the second lifting tray 228 is displaced as print media 300 are removed from the stack 302 due to information gained from the positioning of the media guide 230. Specifically, when the media guide 230 is placed in contact with a stack of relatively narrow print media, i.e., print media having a width less than the width of the second lifting tray 228, the media guide is positioned within the lateral edge of the second lifting tray 228 and only the second lifting tray is engaged for lifting by the lifting mechanism (not shown). Because of this arrangement, the first lifting tray 226 is available for storage of relatively narrow print media (of the same or different size and type). Therefore, a further stack 304 of print media 306 can be stored within the HCI device 102 on the first lifting tray 226 until such time when the print media 306 are needed.

Figure 5:
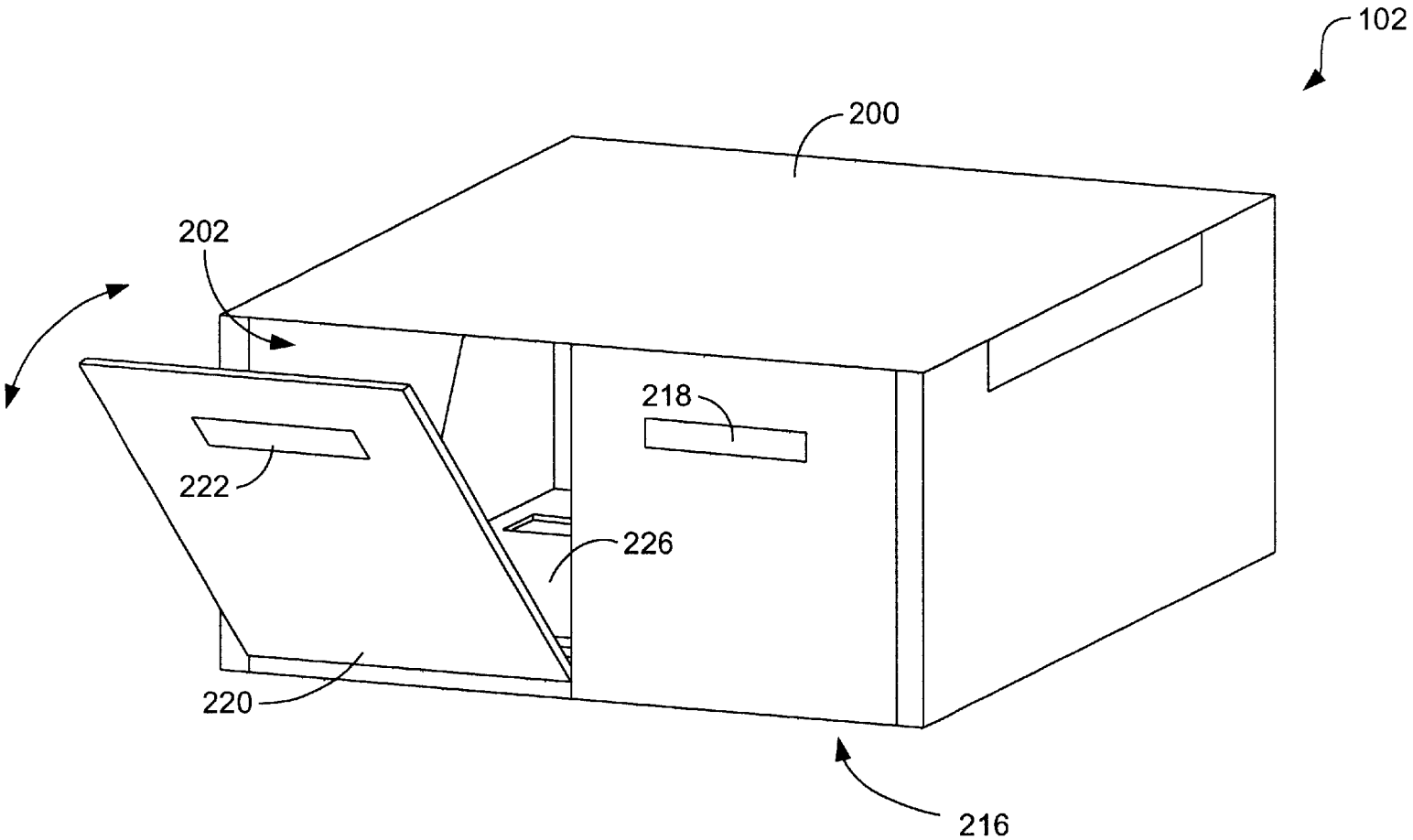
FIG. 5 is a schematic perspective view of the high capacity input device shown in FIG. 2 illustrating operation of a storage compartment door.

With the manner of use described above, more of the interior compartment 224 of the print media drawer 204 can be used, thereby avoiding the wasting of space. In addition to better space utilization, other advantages can be obtained. For instance, where print media are more evenly distributed within the interior compartment 224, the HCI device 102, and any printing device 100 that is mounted on top of it, will be better balanced. Therefore, tipping is less likely. In addition, where print media (e.g., reams of paper) are stored within the interior compartment 224 with the wrappers removed, the media can acclimate to the environment, thereby improving print reliability.

Where the HCI device 102 is used as identified in relation to FIG. 3, it would be advantageous to be able to access the storage compartment (i.e., the portion of the interior compartment associated with the first lifting tray 226) while the HCI device is in use feeding print media from the second lifting tray 228 to the printing device 100. The storage compartment door 220 facilitates such functionality, as is illustrated in FIG. 5. As shown in this figure, the storage compartment door 220 can be hinged at its base so as to open in similar fashion to an oven door. Accordingly, where a user wishes to add or remove print media from the storage compartment (i.e., lifting tray 226), the user need only grip the storage compartment door handle 222, open the door 220, and add or remove the media. Notably, this procedure does not interrupt operation of the HCI device 102 in providing print media to the printing device 100. Accordingly, the print media stored on the second lifting tray 228 are still available for input into the printing device 100.

As noted above, many HCI devices can be used with relatively wide print media. For instance, 11 in.×17 in. paper and A3 paper can be accommodated by several known HCI devices. The HCI device 102 likewise provides this flexibility. Operation with a relatively wide print media is illustrated in FIG. 4. As shown in this figure, the relatively wide media 400 can be placed across both lifting trays 226 and 228 and the media guide 230 brought into contact with the edge of the media stack 402. With this arrangement, the media guide 230 is positioned outside of the lateral edge of the second lifting tray 228 and both lifting trays 226 and 228 are operated (i.e., lifted) in unison so as to provide a substantially continuous support surface for the print media 400. In particular, unlike the situation shown in FIG. 3, the first lifting tray 226 is engaged by the lifting mechanism (not shown) along with the second lifting tray 228 so that the stack 402 can be lifted evenly within the interior compartment 224. Although the compartment 224 cannot be used for separate media storage when operating in the mode shown in FIG. 4, it is to be noted that the HCI device 102 is still well balanced in that the relatively wide print media 400 use the majority of the compartment space.

To avoid unnecessary interruption of the operation of the HCI device 102, the storage compartment door 220 can, optionally, be locked when the HCI device operates in the second mode of operation shown in FIG. 4. By way of example, this locking can be provided by the locking mechanism 236 identified in FIG. 2. As shown in that figure, the locking mechanism 236 can comprise a simple latch that is adapted to engage the door 220 when the position of the media guide 230 indicates that relatively wide media are contained within the interior compartment 224 of the HCI device 102 (i.e., wider than the second lifting tray 228). In some arrangements, this locking mechanism 236 can be actuated when the first lifting tray 226 is engaged by the lifting mechanism.

While particular embodiments of the invention have been disclosed in detail in the foregoing description and drawings for purposes of example, it will be understood by those skilled in the art that variations and modifications thereof can be made without departing from the scope of the invention as set forth in the following claims. For instance, although a "high capacity" input device has been described, it is to be appreciated that the concepts discussed herein apply to print media input devices in general.

What is claimed is:

1. A print media input device, comprising:

a housing that defines an interior space;

a first lifting tray adapted to store print media;

a second lifting tray adapted to feed print media to another device;

a media guide that is adapted to be placed against a stack of print media that is at least supported by the second lifting tray, wherein the media guide indicates a size of the print media; and wherein the first and second lifting trays can be vertically displaced both independently and in unison.

2. The device of claim 1, further comprising a pull-out drawer that supports the first and second trays.

3. The device of claim 2, wherein the drawer defines an interior compartment that can contain print media.

4. The device of claim 3, wherein the interior compartment includes a storage compartment that is associated with the first lifting tray.

5. The device of claim 4, further comprising a storage compartment door that provides access to the storage compartment without interrupting feeding of print media by the input device.

6. The device of claim 5, further comprising a locking mechanism that is used to lock the storage compartment door.

7. The device of claim 1, wherein a position of the media guide identifies a first mode of operation in which only the second lifting tray is to be vertically displaced or a second mode of operation in which both lifting trays are to be vertically displaced in unison.

8. The device of claim 2, wherein the position of the media guide that identifies the first mode of operation is a position in which the media guide is placed within a lateral edge of the second lifting tray.

9. The device of claim 7, wherein the position of the media guide that identifies the second mode of operation is a position in which the media guide is placed outside of a lateral edge of the second lifting tray.

10. A print media input device, comprising:

an outer housing that defines an interior space; and a pull-out drawer that is slidable in and out of the interior space, the drawer supporting first and second lifting trays, the first lifting tray being adapted to store print media and the second lifting tray being adapted to feed print media to another device, the pull-out drawer also comprising a media guide that is adapted to be placed against a stack of print media that is at least supported by the second lifting tray, wherein the media guide indicates a size of the print media.

11. The device of claim 10, further comprising a storage compartment door that provides access to a storage compartment of the input device without interrupting feeding of print media by the input device.

12. The device of claim 11, further comprising a locking mechanism that is used to lock the storage compartment door.

13. The device of claim 10, wherein a position of the media guide identifies a first mode of operation in which only the second lifting tray is vertically displaced or a second mode of operation in which both lifting trays are vertically displaced in unison.

14. The device of claim 13, wherein the position of the media guide that identifies the first mode of operation is a position in which the media guide is placed within a lateral edge of the second lifting tray.

15. The device of claim 13, wherein the position of the media guide that identifies the second mode of operation is a position in which the media guide is placed outside of a lateral edge of the second lifting tray.

16. A method for operating a print media input device, comprising the steps of:

supporting print media with at least one of two lifting trays contained within the input device;

placing a media guide of the input device adjacent the print media; and controlling displacement of the two lifting trays depending upon the position of the media guide, wherein only one lifting tray is displaced when the media guide is in a first position and both lifting trays are displaced in unison when the media guide is in a second position.

17. The method of claim 16, wherein the first position of the media guide is one in which the media guide is within a lateral edge of a second of the two lifting trays.

18. The method of claim 16, wherein the second position of the media guide is one in which the media guide is outside of a lateral edge of a second of the two lifting trays.

* * * * *